US005526835A

United States Patent [19]

Olechow

[11] Patent Number: 5,526,835

[45] Date of Patent: Jun. 18, 1996

[54] FLUID JET SPRAY DRIVE FOR A ROTATABLY MOUNTED TURNTABLE

[76] Inventor: Fred Olechow, 116 Bennett Crescent N.W., Calgary, Alberta, Canada, T2L 1R1

[21] Appl. No.: 342,227

[22] Filed: Nov. 18, 1994

[30] Foreign Application Priority Data

Nov. 24, 1993 [CA] Canada ..... 2109867

[51] Int. Cl.[6] ..... B08B 3/02

[52] U.S. Cl. ..... 134/138; 134/153

[58] Field of Search ..... 134/138, 139, 134/51, 115 R, 153, 179; 184/65

[56] References Cited

U.S. PATENT DOCUMENTS

| | | | |
|---|---|---|---|
| Re. 22,936 | 11/1947 | Wilson | 134/138 |
| 1,165,215 | 12/1915 | Tate | 184/65 |
| 1,525,756 | 2/1925 | McKenney et al. | 134/139 |
| 1,932,246 | 10/1933 | Kirby | 134/139 X |
| 3,422,826 | 1/1969 | Ballard | 134/139 X |
| 3,452,763 | 7/1969 | Ballard | 134/139 X |
| 3,656,491 | 4/1972 | Ballard | 134/139 X |
| 3,779,258 | 12/1973 | Brenner et al. | 134/138 |
| 4,217,920 | 8/1980 | Ballard | 134/141 |
| 4,420,005 | 12/1983 | Armstrong | 134/179 X |

FOREIGN PATENT DOCUMENTS

| | | | |
|---|---|---|---|
| 995101 | 8/1976 | Canada | 134/139 |
| 1138273 | 10/1962 | Germany | 134/138 |

*Primary Examiner*—Philip R. Coe
*Attorney, Agent, or Firm*—Davis, Bujold & Streck

[57] ABSTRACT

A fluid spray jet drive system for a rotatably mounted turntable is described which includes a plurality of closely spaced. radially extending vanes depending from the turntable. A fluid spray jet is disposed below the turntable. The spray jet is substantially vertically aligned thereby directing a jet of fluid substantially vertically at the vanes. The fluid jet drive system, as described, provides a positive drive for slow rotation.

2 Claims, 3 Drawing Sheets

FLUID JET SPRAY DRIVE FOR A ROTATABLY MOUNTED TURNTABLE

FIELD OF THE INVENTION

The present invention relates to a fluid spray jet drive system for a rotatably mounted turntable.

BACKGROUND OF THE INVENTION

Fluid spray jet drive systems for rotatably mounted turntables are known. For example, a fluid spray jet drive system is disclosed in Canadian Patent 995,101 which was granted to Solv-X Inc. in 1976 for a Parts Washing Machine. The teachings of the reference are to direct a substantially horizontal narrow high velocity spray which impinges at an angle upon a wall of a basket positioned on the turntable thus initiating rotation of the turntable. This teaching is consistent with what is presently used, with the exception that in some units the spray is directed at four to eight vanes depending from the turntable.

The problem with fluid drive systems lies in speed regulation. The substantially horizontal narrow high velocity spray generally results in a fast rotational speed, whereas, with parts washing machines it is desirable to have as slow a rotational speed as possible in order to have effective cleaning.

SUMMARY OF THE INVENTION

What is required is an improved fluid spray jet drive system for a rotatably mounted turntable.

According to the invention there is provided a fluid spray jet drive system for a rotatably mounted turntable which includes a plurality of closely spaced radially extending vanes depending from the turntable. A fluid spray jet assembly is disposed below the turntable. The spray jet assembly is substantially vertically aligned thereby directing a jet of fluid substantially vertically at the vanes.

It has been determined that the fluid drive system, as described above, provides a positive fluid drive capable of maintaining slow rotation of the turntable. Critical to the positive drive is the presence of a plurality of closely spaced vanes. The vanes are so closely spaced that by the time the fluid spray is leaving one vane it is already hitting the adjacent vane. Increasing the number of vanes in this fashion would inevitably increase the speed of rotation with a horizontal spray, however, using as vertical a spray angle as possible maintains the desired positive drive without excessive acceleration.

Although beneficial results may be obtained through the use of the fluid drive system, as described above, greater efficiency can be obtained by improving the contact between the jet of spray from the spray jet and the vanes. Even more beneficial results may, therefore, be obtained when the spray jet has a fan-like radius spray. It is preferred that this radiused spray be radiused between 75 and 95 degrees.

There will always remain some need to regulate the speed of the turntable. A speed ideal for one application may be too slow for other applications. The ability of the spray jet to turn the turntable is invariably affected by the weight which is placed on the turntable. With the fluid drive system, as described, speed can be regulated in one or more ways, or by a combination of ways. An adjustment of rotational speed can be effected by varying the p.s.i. of the spray. A range of between 30 p.s.i. and 200 p.s.i. should be suitable for most applications. An adjustment of the rotational speed can be effected by varying the flow rate of the spray. However, once a spray jet has been selected according to turntable size and pump output pressure, an adjustment of rotational speed can best be affected by pivotal adjustment of the spray nozzle to vary the spray angle. A 30 degrees variation should be suitable for most applications.

Although beneficial results may be obtained through the use of the fluid drive system, as described above, turntables of this type require continuous routine maintenance to keep bearings and other moving parts lubricated. The turntable is supported on a substantially vertical shaft which is journalled for rotation in a hub assembly. The hub assembly contains bearings and is sealed by a lip seal. Cleaning solution tends to work its way along the vertical shaft and past the lip seal into the bearings. Moisture then builds up within the hub assembly, which, if not addressed through maintenance procedures, will eventually lead to bearing failure. Even more beneficial results may, therefore, be obtained when the turntable is rotatably mounted on a self-lubricating hub assembly. The hub assembly has a lubrication port connected by conduit to a lubrication reservoir. The lubrication reservoir is vertically spaced higher than the hub assembly such that lubricant is gravity fed as required from the lubrication reservoir through the conduit to the hub assembly.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred embodiment, a fluid spray jet drive system for a rotatably mounted turntable will now be described with reference to FIGS. 1 through 5.

Figure 1:
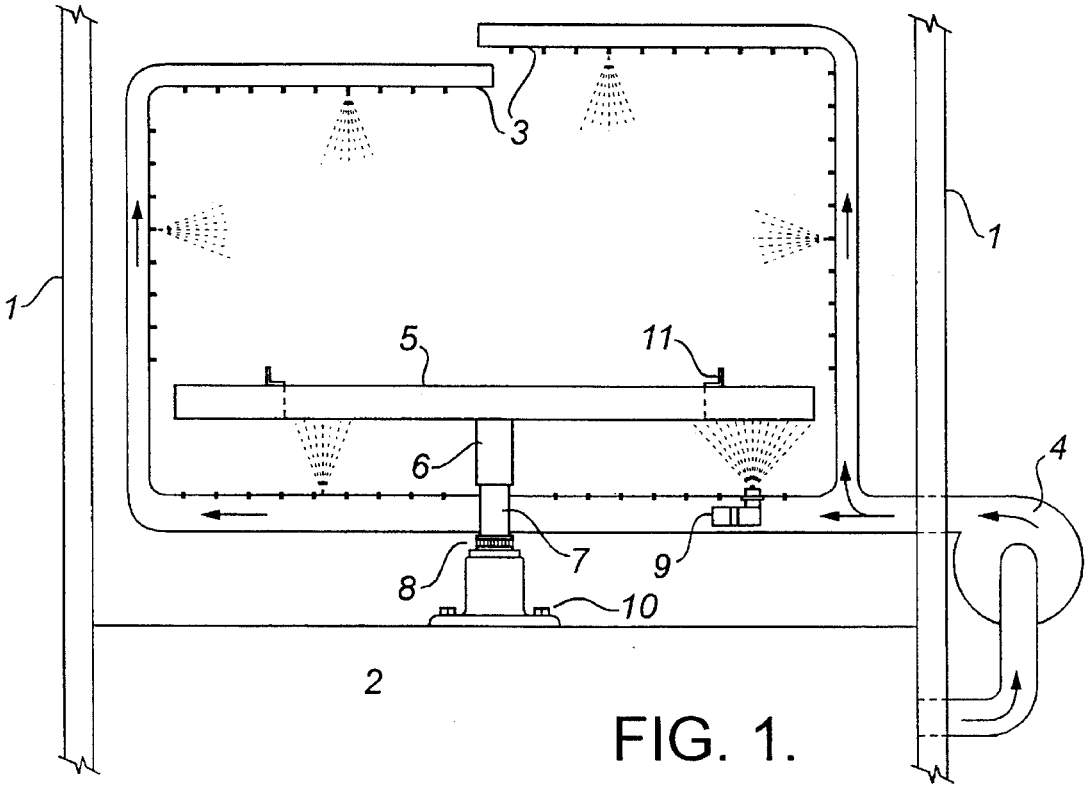
FIG. 1 is a front elevation view of a fluid drive system in accordance with teachings of the present invention.
Figure 2:
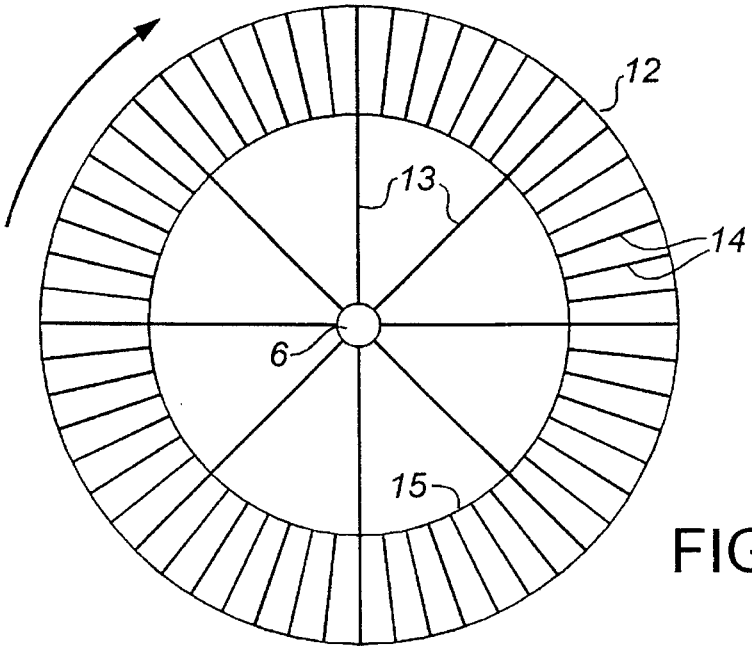
FIG. 2 is a bottom plan view of the fluid drive system illustrated in FIG. 1.
Figure 3:
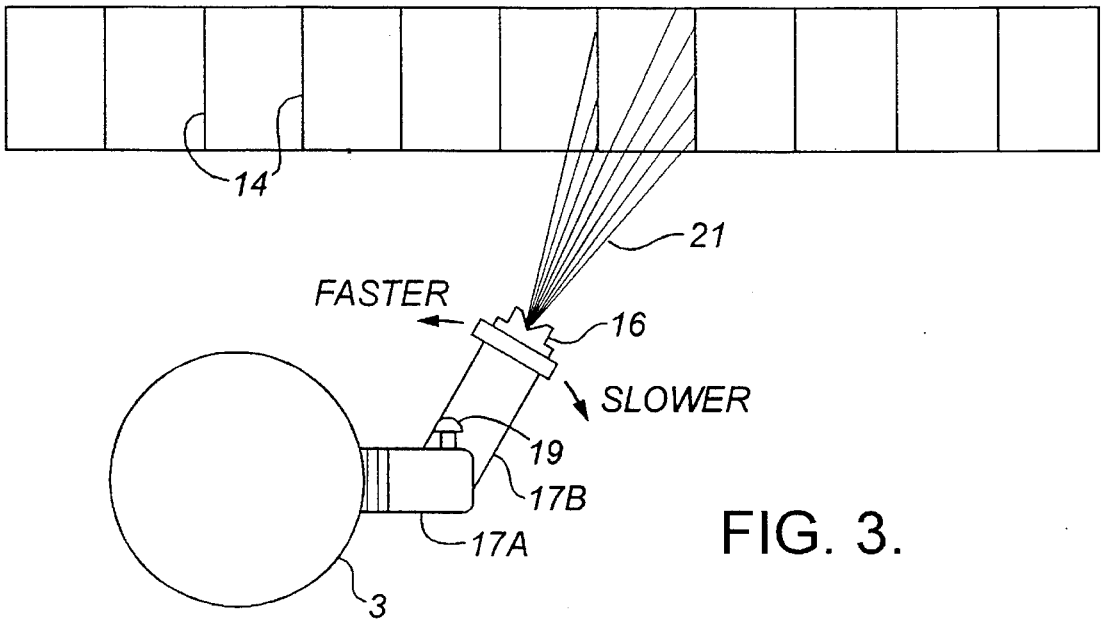
FIG. 3 is a detailed view of a spray jet from the fluid drive system illustrated in FIG. 1.
Figure 4:
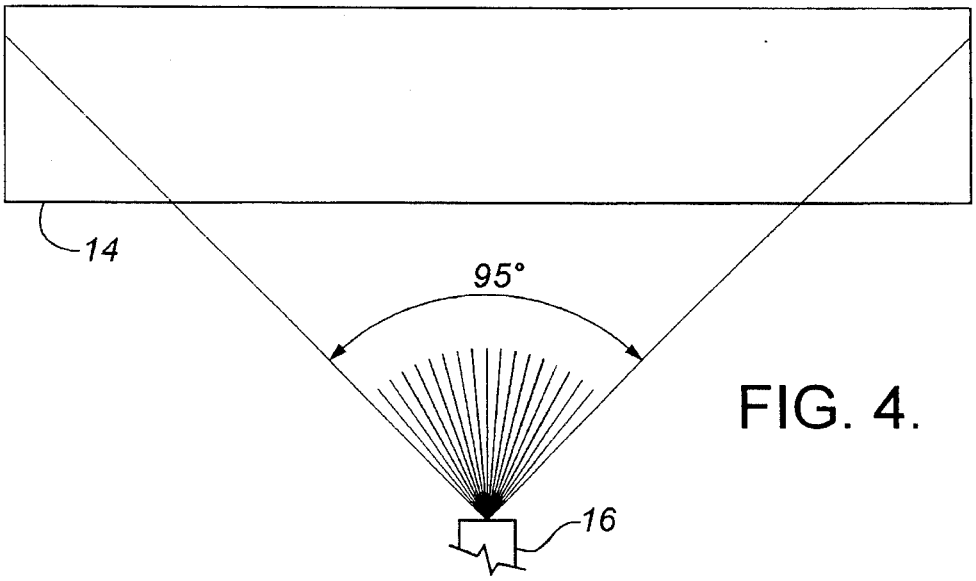
FIG. 4 is a detailed view of a preferred spray jet spray pattern from the spray jet illustrated in FIG. 3.

Referring to FIG. 1 there is illustrated a cabinet 1. Parts washer cabinet 1 has a cleaning solution tank 2 and a cleaning spray manifold 3. Cleaning solution is pumped from tank 2 into cleaning spray manifold 3 by pump 4. The spray is directed at a turntable 5. Turntable 5 is rotatably mounted by means of a centrally positioned sleeve 6 that slides over a vertical shaft 7. Shaft 7 is part of a greater hub assembly 8 bolted by bolts 10 to tank 2. Turntable 5 has upper rails 11 to maintain a basket containing parts (not shown) in position. The fluid drive system for parts washer 1 will now be described. Referring to FIG. 2, a plurality of closely spaced radially extending vanes 14 depend from turntable 5. A fluid spray jet assembly 9 is disposed below turntable 5. Spray jet assembly 9 is substantially vertically aligned and directs a jet of fluid spray substantially vertically at vanes 14. In order to emphasize the manner in which the spacing of vanes 14 differs from the prior art, eight vanes 13 are illustrated as they appeared prior to modification in accordance with the teachings of the present invention by the addition of vanes 14. It is preferred that vane spacing be within 2 inches. Good results have been obtained using two inch deep vanes having a nominal spacing of 1.5 inches. Vanes 14 are confined between an outer rim 12 and an inner rim 15. It is preferred that spray jet assembly 9 be pivotally movable by approximately 30 degrees, as illustrated in FIG. 3. This ability to pivot spray jet assembly 9 is important to the preferred method of regulating rotational speed as will hereinafter be further described. In this embodiment, spray jet assembly 9 is supplied with fluid by spray manifold 3. Spray jet assembly 9 has a fixed portion 17A and a pivotable portion 17B. A locking screw 19 is provided to lock pivotable portion 17B in a selected position relative to fixed portion 17A. A radiused nozzle 16 is disposed in spray jet assembly 9 to project a planar fan-like radiused spray pattern 21 onto vane 14, as illustrated in FIG. 4. This radiused spray pattern 21 maximizes contact between the spray and the vanes. It is preferred that spray pattern 21 be radiused between 75 and 95 degrees.

Figure 5:
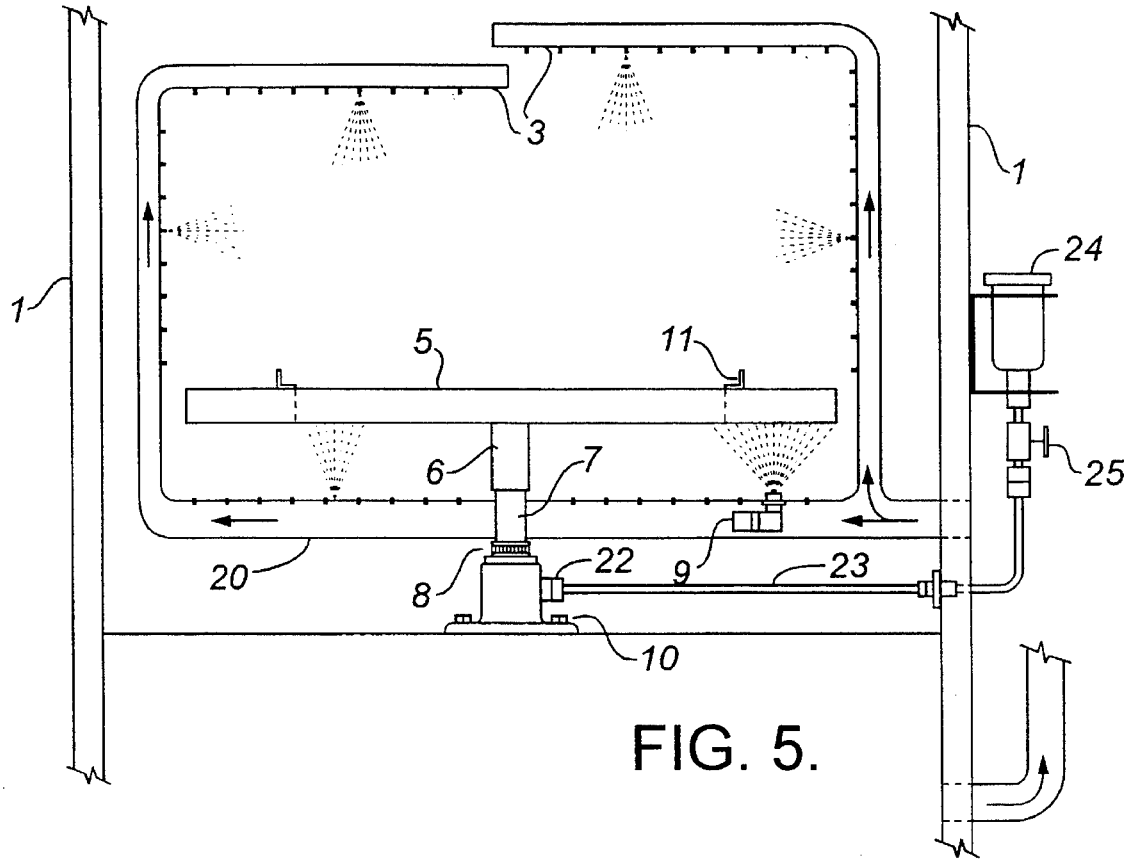
FIG. 5 is a front elevation view of the fluid drive system illustrated in FIG. 1, to which has been added a hub lubrication apparatus.

Referring to FIG. 5, there is illustrated a modification to hub assembly 8 in order to make it self-lubricating. Hub assembly 8 has been modified by the addition of a lubrication port 22 connected by conduit 23 to a lubrication reservoir 24. Lubrication reservoir 24 is secured to cabinet 1 vertically spaced so it is higher than hub assembly 8. A shut off valve 25 is positioned on conduit 23, to facilitate servicing.

The use and operation of the fluid drive system will now be described with reference to FIGS. 1 through 5. With the fluid drive system, fluid is directed through spray jet assembly 9 onto vanes 14. The drive system departs from the prior art in that vanes 14 are closely spaced and spray jet assembly 9 has a substantially vertical spray. The greater the angle of deviation of the spray from vertical the faster turntable 5 will rotate, it is therefore desirable to have spray jet assembly 9 as vertical as possible while still maintaining a positive rotation. With vanes 14 closely spaced, by the time the fluid spray is leaving one vane it is already hitting the adjacent vane. It is preferred that a planar fanlike radiused spray pattern 21 be used as illustrated in FIG. 4. This makes for the most effective driving force as the contact between the spray and vanes 14 is maximized.

The amount of force required to rotate turntable 5 varies with the load. Of course, it takes less force to rotate a lightly loaded turntable that it does to rotate a heavily loaded turntable. The force exerted by spray jet assembly 9 can be adjusted in a number of ways. The preferred way is by adjusting the angle of spray jet assembly 9. Referring to FIG. 3, this is accomplished by loosening locking screw 19 and pivoting pivotable portion 17B relative to fixed portion 17A to provide a less vertical spray angle. Care must be taken in varying too much from vertical, for as is shown in the prior art, it is difficult to maintain slow speed rotation with a horizontal spray. Good results have been obtained with a variation of 30 degrees.

It should be noted that there are other ways to adjust the force of the spray. For example, the force exerted to rotate turntable 5 can be adjusted by varying the p.s.i. of the spray between 30 p.s.i. and 200 p.s.i. As well, the force exerted to rotate turntable 5 can be adjusted by varying the flow rate of the spray.

Referring to FIG. 5, lubricant is gravity fed as required from lubrication reservoir 24 through conduit 23 to hub assembly 8. The continuous supply of lubricant to hub assembly 8 under slight positive pressure, as provided by the gravity feed, helps prevent the incursion of cleaning fluid into hub 8.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. A fluid spray jet drive system for a rotatably mounted turntable, comprising:

a. a plurality of closely spaced radially extending vanes depending from the turntable, each vane being spaced less than two inches apart from adjacent vanes;

b. a fluid spray jet assembly disposed below the turntable, the spray jet assembly being substantially vertically aligned thereby directing a jet of fluid substantially vertically at the vanes, the spray jet assembly having a fan-like radiused spray in a range of 75 to 95 degrees, thereby increasing the contact between the spray and the vanes; and c. the spray jet assembly being pivotally movable about a substantially horizontal axis from vertical by approximately 30 degrees thereby providing a means of regulating rotational speed of the turntable during use.

2. The fluid spray jet drive system as defined in claim 1, wherein the turntable is rotatably mounted on a self-lubricating hub assembly, the hub assembly having a lubrication port connected by conduit to a lubrication reservoir, the lubrication reservoir being vertically spaced higher than the hub assembly such that lubricant is gravity fed as required from the lubrication reservoir through the conduit to the hub assembly.

* * * * *